US005992563A

United States Patent [19]

Kessler et al.

[11] Patent Number: 5,992,563

[45] Date of Patent: Nov. 30, 1999

[54] MULTIPIECE INTERFITTING STEPS FOR A SWIMMING POOL

[75] Inventors: Emerich Kessler, Fort Lee; Arie Wilensky, Livingston, both of N.J.

[73] Assignee: Skyller Associates L.L.C., Livingston, N.J.

[21] Appl. No.: 09/192,156

[22] Filed: Nov. 13, 1998

[51] Int. Cl.[6] ..... E06C 7/18

[52] U.S. Cl. ..... 182/106; 182/33.5; 297/440.1

[58] Field of Search ..... 182/106, 33.5, 182/33; 297/118, 1, 423.1, 440.1, 440.14, 248, 440.15, 440.2, 440.24; D25/65; D6/350, 352

[56] References Cited

U.S. PATENT DOCUMENTS

| | | | |
|---|---|---|---|
| 934,316 | 9/1909 | Jones | 182/33.5 |
| 2,805,703 | 9/1957 | Wise | 182/33.5 |
| 3,826,336 | 7/1974 | Cramer | 182/106 X |
| 4,537,282 | 8/1985 | Lobdell | 182/129 X |

*Primary Examiner*—Daniel P. Stodola
*Assistant Examiner*—Hugh B. Thompson
*Attorney, Agent, or Firm*—Richard M. Goldberg

[57] ABSTRACT

A step assembly for a swimming pool, includes an upper step section including two upper steps at a first height, front, side and rear supporting walls for supporting the two upper steps on a ground surface, a hollow chamber defined between the supporting walls and the upper steps, and an opening in the rear wall for permitting access to the hollow chamber; a lower step section including two lower steps at a second height lower than the first height, front, side and rear supporting walls for supporting the two lower steps, and the lower step section having dimensions less than the opening so as to fit through the opening and be removably positioned in the hollow chamber; and a securing assembly which removably secures the upper step section with the lower step section, and including a tongue in the rear wall of the lower step section and a groove in the front wall of the upper step section which removably receives the tongue.

21 Claims, 8 Drawing Sheets

MULTIPIECE INTERFITTING STEPS FOR A SWIMMING POOL

BACKGROUND OF THE INVENTION

The present invention relates generally to swimming pools, and more particularly, is directed to multipiece interfitting steps for a swimming pool.

A problem with swimming pools, and particularly, above-ground swimming pools is the accessability for elderly and infirm people. Generally, a ladder is provided for entering and leaving the swimming pool. However, elderly and infirm people find such ladders difficult to manage. In addition, such ladders are not very sturdy, so that such people can easily fall or lose their balance.

In order to overcome these problems, a one-piece plastic molded step assembly has been provided which fits into the pools, and which is weighted down by sand bags or the like. The advantage is that elderly and infirm people can walk down the steps, from a deck into the above-ground swimming pool, or into an in-ground pool, with little difficulty. Such step assembly is relatively sturdy, and generally provides three or four steps, along with one or two handrails secured to the step assembly that can be held by the person.

A problem with such step assemblies, however, is that they are very bulky. Therefore, in addition to being difficult to manage, that is, difficult to set up or insert into the pool, such step assemblies are difficult to ship because of the large size thereof. As a result, the shipping costs are relatively high compared to the cost of the step assembly itself.

OBJECTS AND SUMMARY OF THE INVENTION

Accordingly, it is an object of the present invention to provide a step assembly for swimming pools that overcomes the problems with the aforementioned prior art.

It is another object of the present invention to provide a step assembly for swimming pools that can be easily handled during set-up.

It is still another object of the present invention to provide a step assembly for swimming pools that is provided in multiple pieces that interfit with each other.

It is yet another object of the present invention to provide a step assembly for swimming pools in which the pieces can fit within each other, substantially reducing the size and bulk of the step assembly for shipping and storage.

It is a further object of the present invention to provide a step assembly for swimming pools that has high structural integrity when assembled.

It is a still further object of the present invention to provide a step assembly for swimming pools that is easy and economical to use and manufacture.

In accordance with an aspect of the present invention, a step assembly for a swimming pool, includes an upper step section including at least one upper step at a first height, a first supporting structure for supporting the at least one upper step on a ground surface, a hollow chamber defined between the first supporting structure and the at least one upper step, and an opening in the first supporting structure for permitting access to the hollow chamber. A lower step section includes at least one lower step at a second height lower than the first height, a second supporting structure for supporting the at least one lower step, and the lower step section having dimensions less than the opening so as to fit through the opening and be removably positioned in the hollow chamber. Finally, a securing assembly removably secures the upper step section with the lower step section.

The at least one upper step preferably includes two steps of different heights which are offset from each other in a horizontal direction and which are connected to each other by a riser.

In addition, the step assembly includes at least one hand rail, and the upper step section further includes hand rail holding sections for holding the at least one hand rail thereon. Preferably, there are at least two hand rail holding sections, each including a cup-shaped wall for receiving an end of one hand rail therein, at least one cup-shaped wall being associated with a first one of the steps of the upper step section and at least one cup-shaped wall being associated with a second one of the steps of the upper step section.

The first supporting structure includes a front wall connected with the at least one upper step, opposite side walls connected with the at least one upper step and with the front wall, a rear wall connected with the at least one upper step and the side walls, and having the opening therein, and a bottom wall having a second opening therein to permit water to enter into the upper step section when the upper step section is positioned in a swimming pool.

The securing assembly includes a first securing device on the first supporting structure, and a second securing device on the second supporting structure for engaging with the first securing device to releasably secure the upper step section with the lower step section.

Preferably, the first securing device includes a groove and the second securing device includes a tongue which can removably fit within the groove. Specifically, the first supporting structure includes a front wall and the groove is formed in the front wall, and the second supporting structure includes a rear wall and the tongue is formed in the rear wall.

The groove is open at a lower edge thereof, and the tongue has similar dimensions and shape to the groove so as to removably fit within the groove.

The first securing device further includes a substantially C-shaped guiding wall formed with the respective one of the first and second supporting structures, the guiding wall extending substantially an entire height of the groove and defining a chamber therein which is in open communication with the groove, and the tongue includes a main body portion and a reduced neck portion by which the main body portion is connected with the respective one of the first and second supporting structures, the main body portion having a configuration and dimensions complementary to fit within the substantially C-shaped guiding wall and the reduced neck portion having a configuration and dimensions complementary to fit within the groove. The guiding wall inclines away from the respective one of the first and second supporting structures in a downward direction, and the main body portion inclines away from the respective one of the first and second supporting structures in a downward direction, in a complementary manner to the C-shaped guiding wall.

The groove and the substantially C-shaped guiding wall preferably each have a substantially trapezoidal configuration such that side edges of the groove converge toward each other in an upward direction and side edges of the guiding wall converge toward each other in the upward direction, and the main body portion and the reduced neck portion of the tongue each have a substantially trapezoidal configuration of similar dimensions and shape to the guiding wall and the groove, respectively, such that side edges of the main body portion converge toward each other in the upward direction and side edges of the reduced neck portion converge toward each other in the upward direction.

The at least one lower step includes two steps of different heights which are offset from each other in a horizontal direction and which are connected to each other by a riser.

The second supporting structure includes a front wall connected with the at least one lower step, opposite side walls connected with the at least one lower step and with the front wall, a rear wall connected with the at least one lower step and the side walls, and a bottom wall having a second opening therein to permit water to enter into the lower step section when the lower step section is positioned in a swimming pool. At least one other wall of the second supporting structure includes a further opening for permitting egress of the water from within the second supporting structure.

The above and other objects, features and advantages of the present invention will become readily apparent from the following detailed description thereof which is to be read in connection with the accompanying drawings.

DETAILED DESCRIPTION

Figure 1:
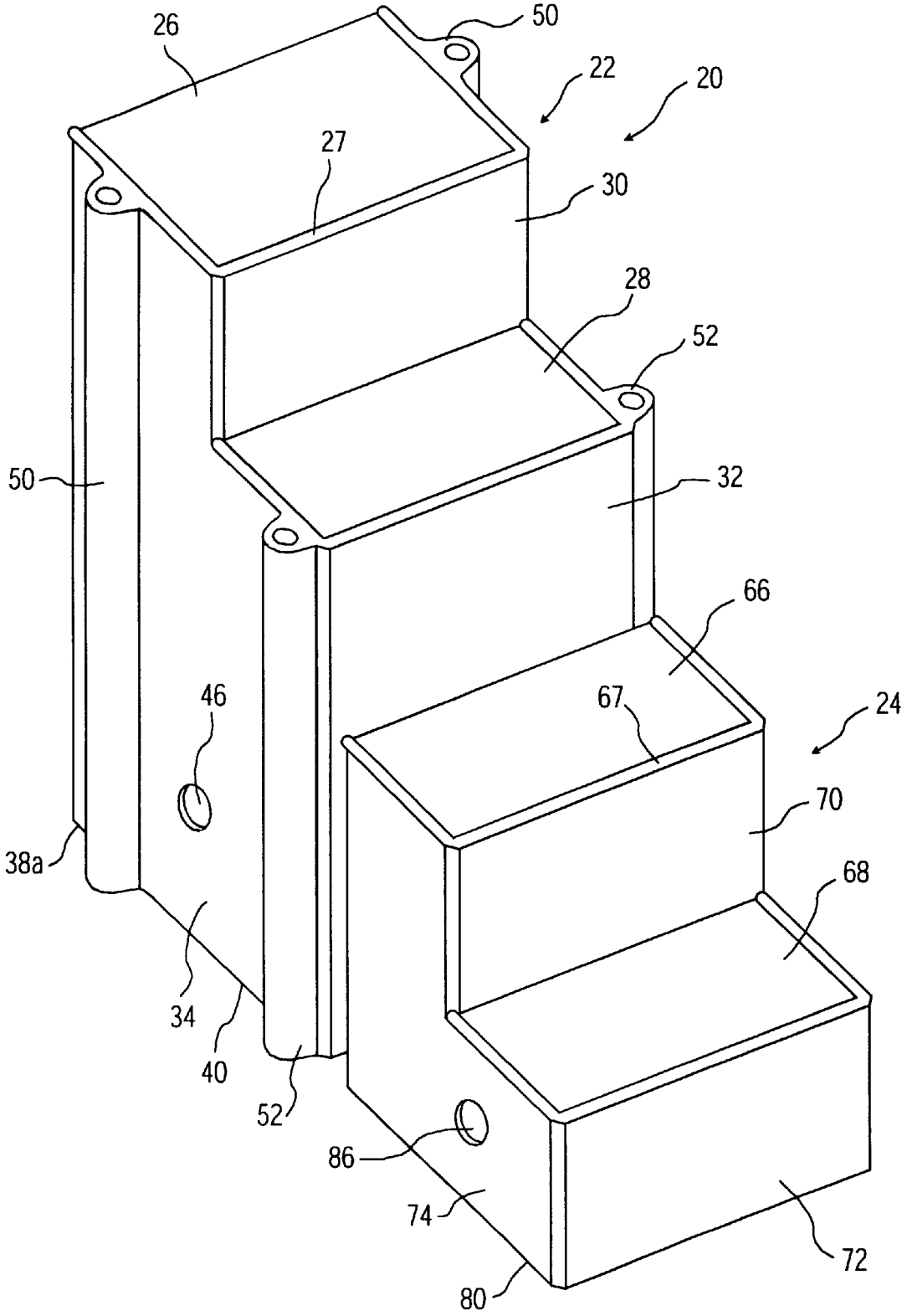
FIG. 1 is a perspective view of a step assembly for swimming pools according to the present invention, in fully assembled condition.
Figure 2:
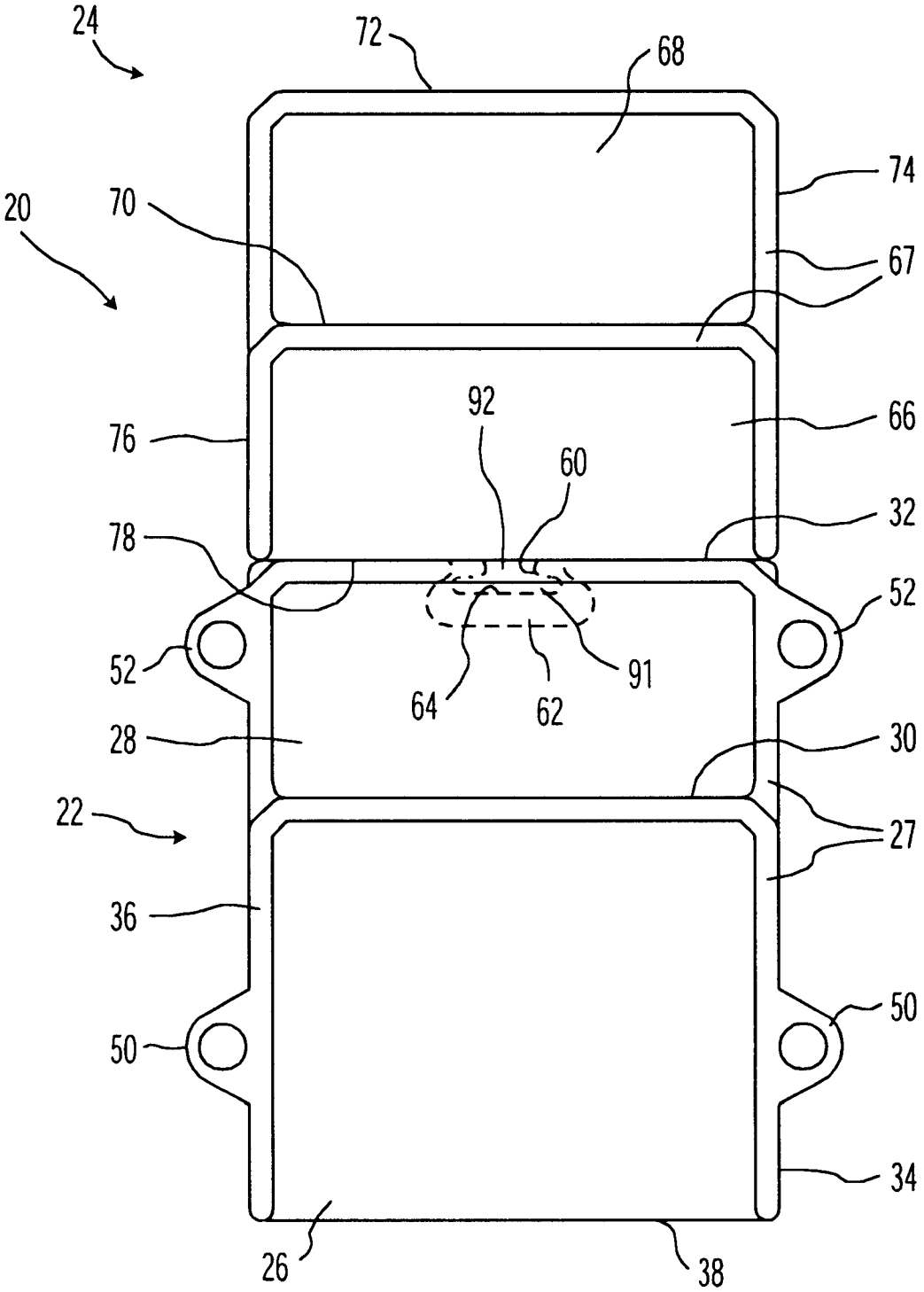
FIG. 2 is a top plan view of the step assembly of FIG. 1.

Referring to the drawings in detail, a step assembly 20 for swimming pools according to the present invention, is shown to include an upper step section 22 and a lower step section 24 which can detachably interfit with each other to form step assembly 20. Upper step section 22 and lower step section 24 are formed from a relatively tough, thin walled, molded plastic material. Therefore, as will be appreciated from the discussion hereinafter, upper step section 22 and lower step section 24 each have a hollow interior to reduce the weight thereof and to reduce the size thereof during shipping and storage.

Figure 11:
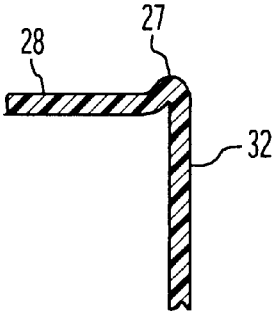
FIG. 11 is a cross-step sectional view of the upper step section, taken along line 11—11 of FIG. 5.
Figure 12:
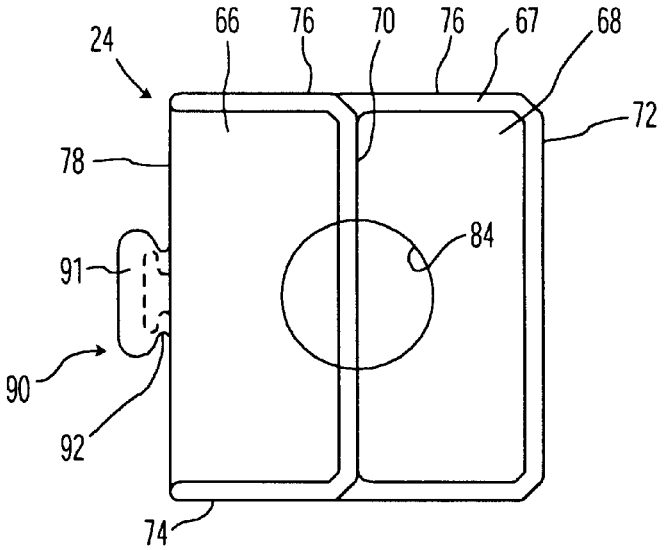
FIG. 12 is a top plan view of the lower step section of the step assembly of FIG. 1.
Figure 13:
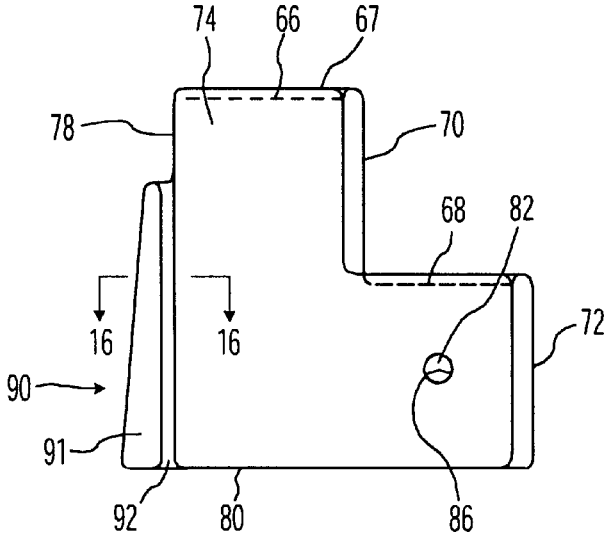
FIG. 13 is a left side elevational view of the lower step section of FIG. 12.
Figure 14:
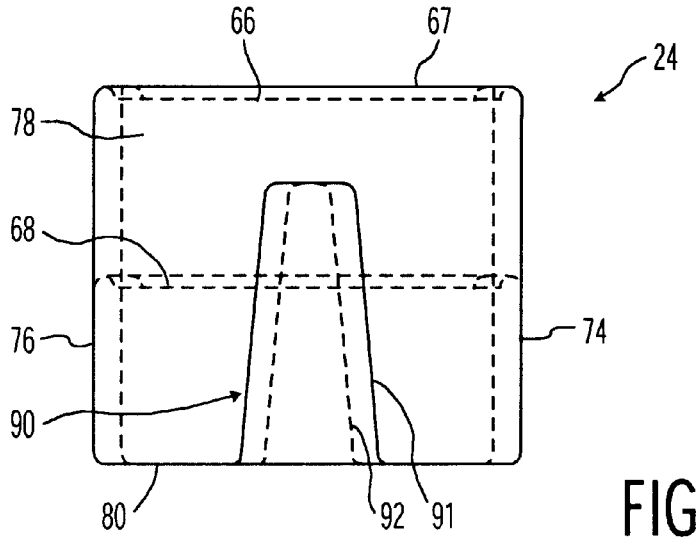
FIG. 14 is a rear elevational view of the lower step section of FIG. 12.
Figure 15:
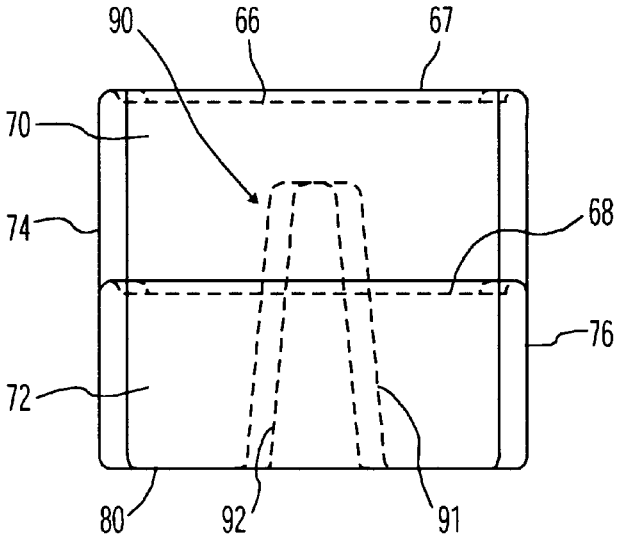
FIG. 15 is a front elevational view of the lower step section of FIG. 5.
Figure 16:
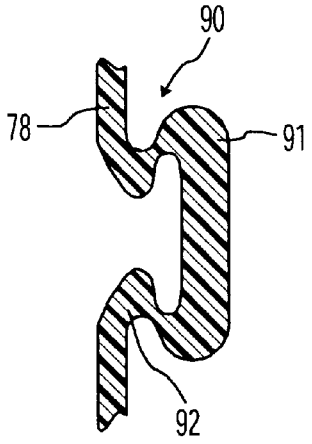
FIG. 16 is a cross-sectional view of the lower section, taken along line 16—16 of FIG. 15.

Referring initially to FIGS. 1–11, upper step section 22 includes at least one step, and preferably, a plurality of steps. Upper step section 22 is shown with an uppermost step 26 and a next lower step 28, although the present invention is not limited to two steps. Steps 26 and 28 are formed in a substantially rectangular configuration, although the present invention is not limited thereto, and therefore, steps 26 and 28 can be formed in any other suitable configuration, such as circular, oval, arcuate, etc. Steps 26 and 28 are provided in parallel, vertically spaced relation, with step 26 being higher than step 28, and with the front edge of step 26 being aligned with the rear edge of step 28, and connected thereat by a vertical riser 30. In addition, as best shown in FIG. 11, each step 26 and 28 has a raised edge 27 at the front and side edges thereof to prevent slipping by a person, and the upper surface of each step 26 and 28 can include ribs or the like (not shown) to further prevent slipping.

A supporting structure for supporting steps 26 and 28 above a ground surface is provided by a vertical front wall or front riser 32, left and right vertical side walls 34 and 36, and a vertical rear wall 38. Front riser 32 is connected at its upper edge to the front edge of step 28, and its lower edge provides support for upper step section 22 on a ground surface. Left and right vertical side walls 34 and 36 are connected at their front edges to the side edges of front riser 32, and are shaped at their upper edges to conform to the shape of uppermost step 26, riser 30 and the next lower step 28, and connected therewith. Vertical rear wall 38 has side edges connected to the rear edges of left and right vertical side walls 34 and 36, and an upper edge connected to the rear edge of uppermost step 26. The lower portion 38*a* of vertical rear wall 38 is inclined inwardly toward front riser 32 in order to accommodate the cove at the lower edge of the swimming pool.

The supporting structure also includes a bottom wall 40 connected at its edges to the lower edges of front riser 32, left and right vertical side walls 34 and 36, and lower portion 38*a* of vertical rear wall 38.

As discussed above, upper step section 22 is made from a thin walled, plastic material, and therefore forms a hollow chamber 42 therein.

When upper step section 22 is placed in the water in a swimming pool, it is necessary that the water be displaced. In order to aid in the insertion of upper step section 22, and the displacement of the water, bottom wall 40 has a large opening 44 therein by which the water beneath bottom wall 40 can escape into chamber 42. In addition, side walls 34 and 36 can be provided with openings 46 to relieve the pressure on side walls 34 and 36 during such insertion.

Further, according to an important aspect of the present invention, rear wall 38 includes a large rectangular opening 48 which serves a dual purpose of allowing entry and removal of lower step section 24 into chamber 42 during shipping and storage of step assembly 20, and also provides for the egress of water that has entered chamber 42 through bottom opening 44 during insertion of upper step section 22 in the water.

Figure 7:
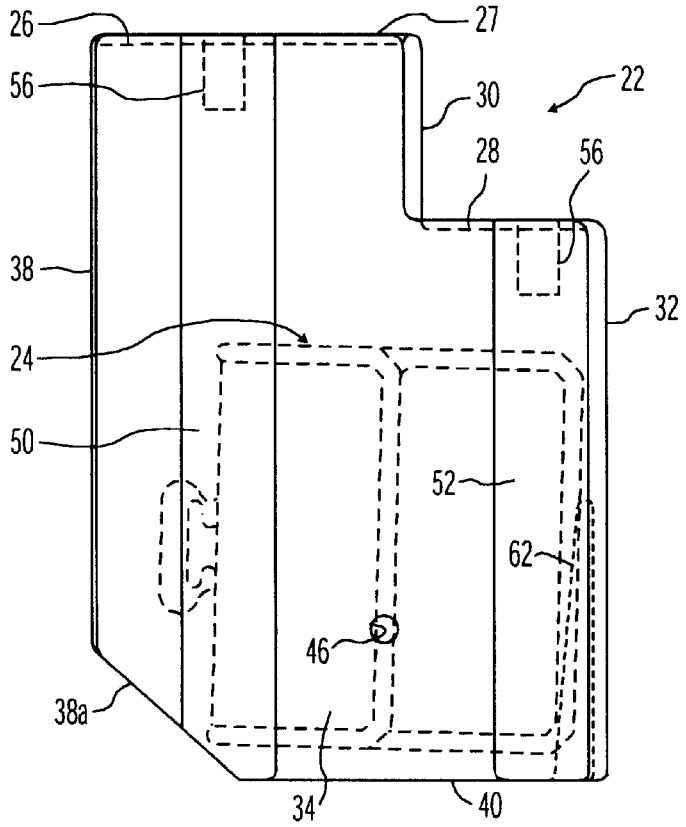
FIG. 7 is a left side elevational view of the upper step section of FIG. 5.
Figure 8:
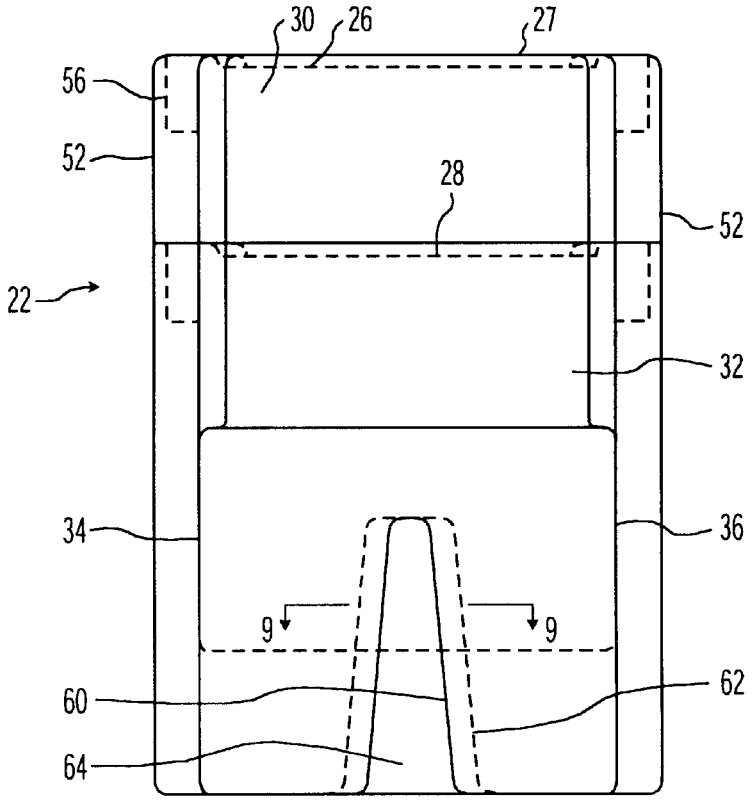
FIG. 8 is a front elevational view of the upper step section of FIG. 5.
Figure 9:
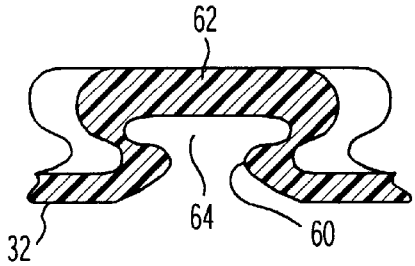
FIG. 9 is a cross-step sectional view of the upper step section, taken along line 9—9 of FIG. 8.
Figure 10:
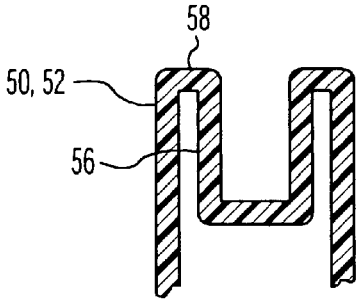
FIG. 10 is a cross-step sectional view of the upper step section, taken along line 10—10 of FIG. 5.

It will be appreciated that, with lower step section 24 inserted into upper step section 22, as shown in FIG. 7, the entire shipping dimensions of step assembly 20 are the same as those of upper step section 22 only. This substantially reduces the bulk and size of step assembly 20 to be shipped, so that step assembly 20 can be shipped in conventional packaging, for example, by United Parcel Service (UPS), thereby greatly reducing the shipping costs of step assembly 20 in comparison to a comparable step assembly which is a one piece unit.

Figure 3:
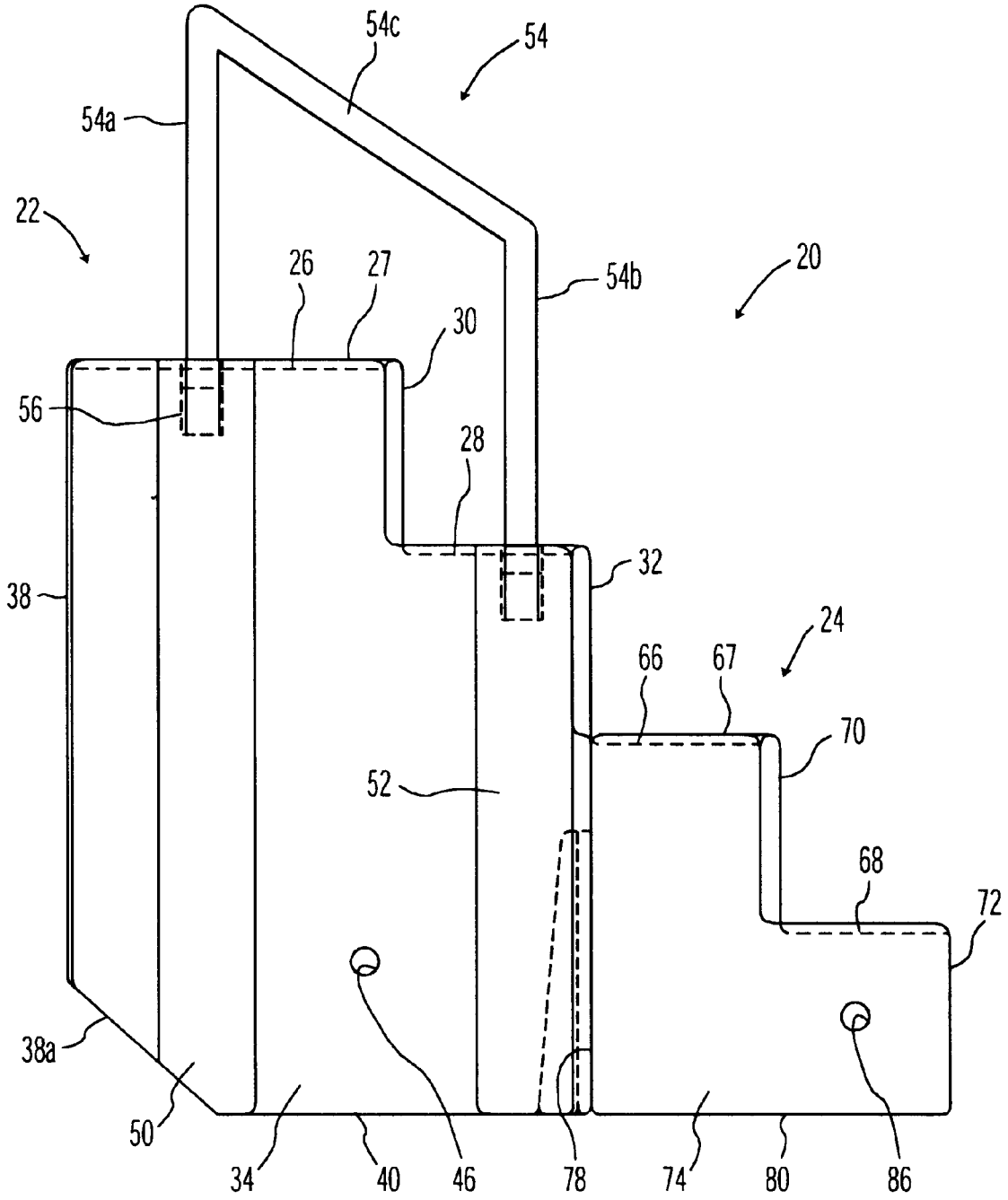
FIG. 3 is left side elevational view of the step assembly of FIG. 1.
Figure 4:
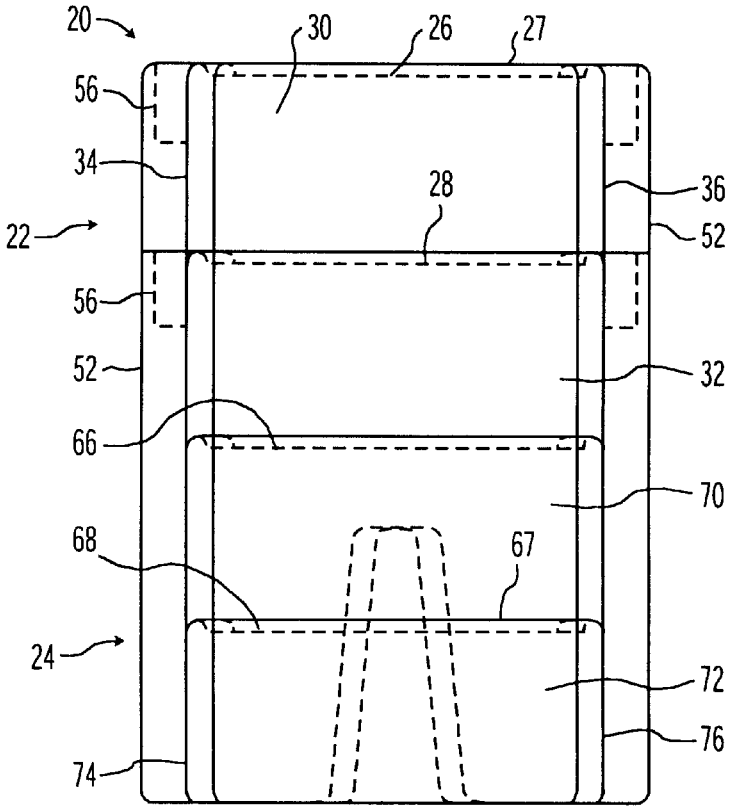
FIG. 4 is a front elevational view of the step assembly of FIG. 1.
Figure 5:
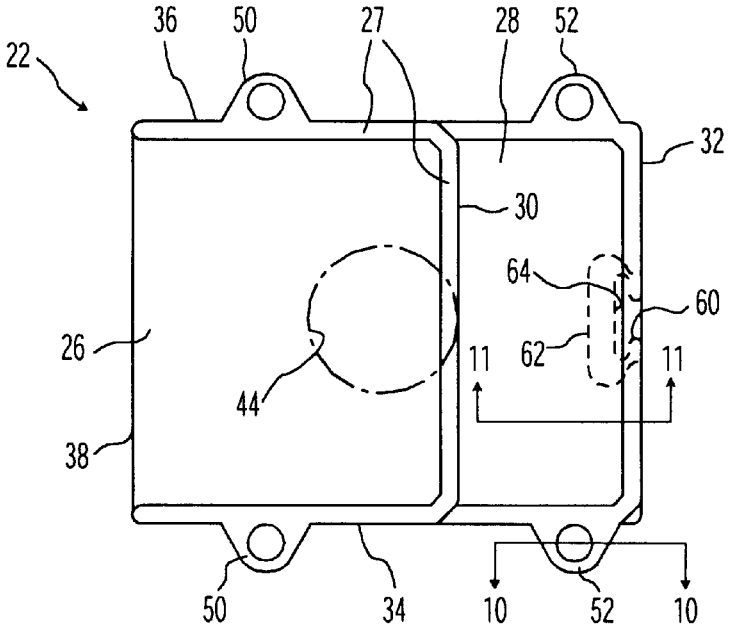
FIG. 5 is a top plan view of the upper step section of the step assembly of FIG. 1.
Figure 6:
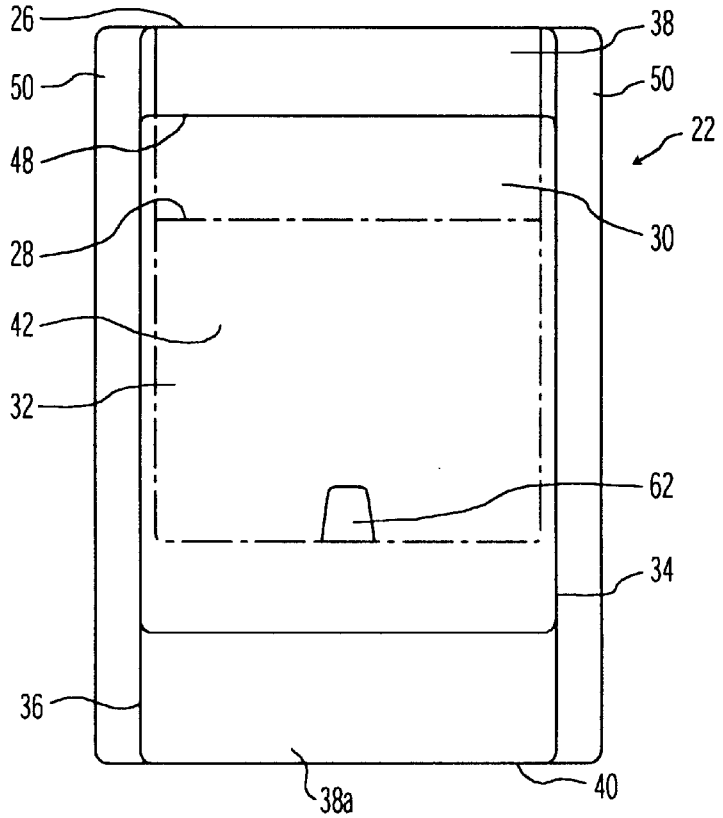
FIG. 6 is a rear elevational view of the upper step section of FIG. 5.

Upper step section 22 further includes hollow, thin walled semi-cylindrical sections 50 and 52 for holding hand rails 54, as shown in FIG. 3, and for further aiding in the support of upper step section 22 on a ground surface. Specifically, there are two sections 50 integrally formed at outer surfaces of side walls 34 and 36 adjacent uppermost step 26, and two sections 52 integrally formed at outer surfaces of side walls 34 and 36 adjacent next lower step 28. A cup-shaped, cylindrical wall 56 is positioned in each section 50 and 52, and has an upper annular connecting wall 58 connected with the upper edge of each section 50 and 52. Accordingly, cup-shaped, cylindrical walls 56 support the ends of hand rails 54 therein, and also limit the extent that such ends can travel within semi-cylindrical sections 50 and 52, that is, to accurately position hand rails 54 at a particular location.

As shown in FIG. 3 only, each hand rail 54 includes a first vertical section 54*a,* a second vertical section 54*b* and an inclined connecting section 54*c* such that the respective upper and lower ends of vertical section 54*b* are positioned lower than the upper and lower ends of vertical section 54*a*. In this regard, the lower ends of vertical sections 54*a* fit within cup-shaped cylindrical walls 56 associated with semi-cylindrical sections 50 and the lower ends of vertical sections 54*b* fit within cup-shaped cylindrical walls 56 associated with semi-cylindrical sections 52. Thus, a person walking up or down the steps can grasp hand rails 54 for better support. Screws or bolts can be provided through sections 50 and 52, and through cylindrical walls 56, and then through hand rails 54 to lock the same in place.

In accordance with another important aspect of the present invention, front riser 32 is provided with an elongated vertical groove 60, which is open at the lower edge of front riser 32. Preferably, groove 60 has a trapezoidal configuration such that the side edges of groove 60 converge toward each other in an upward direction, although the present invention is not limited thereto. A substantially C-shaped guiding wall 62 is integrally formed at the inner surface of front riser 32 and extends the entire height of groove 60. Preferably, C-shaped guiding wall 62 inclines away from front riser 32 in a downward direction, thereby defining a substantially oval chamber 64 therein, which is in open communication with groove 60 and which decreases in size from a lower end to an upper end thereof. Groove 60 and guiding wall 62 serve to removably connect lower step section 24 to the front of upper step section 22, as will be explained hereinafter.

Referring now to FIGS. 12–16, lower step section 24 includes at least one step, and preferably, a plurality of steps. Lower step section 24 is shown with an uppermost step 66 and a next lower step 68, although the present invention is not limited to two steps. Steps 66 and 68 are formed in a substantially rectangular configuration, although the present invention is not limited thereto, so that steps 66 and 68 can be formed in any other suitable configuration, such as circular, oval, arcuate, etc. Steps 66 and 68 are provided in parallel, vertically spaced relation, with step 66 being higher than step 68, and with the front edge of step 66 being aligned with the rear edge of step 68, and connected thereat by a vertical riser 70. It will be appreciated that uppermost step 66 is lower than step 28 of upper step section 22, and forms a next step after step 28 of step assembly 20.

In addition, in the same manner as shown in FIG. 11, each step 66 and 68 has a raised edge 67 at the front and side edges thereof to prevent slipping by a person, and the upper surface of each step 66 and 68 can include ribs or the like (not shown) to further prevent slipping.

A supporting structure for supporting steps 66 and 68 above a ground surface is provided by a vertical front wall or front riser 72, left and right vertical side walls 74 and 76, and a vertical rear wall 78. Front riser 72 is connected at its upper edge to the front edge of step 68, and its lower edge provides support for lower step section 24 on a ground surface. Left and right vertical side walls 74 and 76 are connected at their front edges to the side edges of front riser 72, and are shaped at their upper edges to conform to the shape of uppermost step 66, riser 70 and the next lower step 68, and are connected therewith. Vertical rear wall 78 has side edges connected to the rear edges of left and right vertical side walls 74 and 76, and an upper edge connected to the rear edge of uppermost step 66.

The supporting structure also includes a bottom wall 80 connected at its edges to the lower edges of front riser 72, left and right vertical side walls 74 and 76, and vertical rear wall 78.

Lower step section 24 is made from a thin walled, plastic material, and therefore forms a hollow chamber 82 therein.

When lower step section 24 is placed in the water in a swimming pool, it is necessary that the water be displaced. In order to aid in the insertion of lower step section 24, and the displacement of the water, bottom wall 80 has a large opening 84 therein by which the water beneath bottom wall 80 can escape into chamber 82. In addition, side walls 74 and 76 are provided with openings 86 to relieve the pressure on side walls 74 and 76 during such insertion.

In accordance with another important aspect of the present invention, rear wall 78 is provided with an elongated vertical tongue 90 having a C-shaped cross-section and integrally formed on the outer surface thereof. Vertical tongue 90 includes a substantially C-shaped main body portion 91 and a reduced neck portion 92 by which main body portion 91 is connected with rear wall 78, and extends to the lower edge of rear wall 78. Preferably, reduced neck portion 92 and main body portion 91 each have a substantially trapezoidal configuration of similar dimensions and shape to groove 60 and oval chamber 64 of guiding wall 62, respectively, such that the side edges of main body portion 91 and reduced neck portion 92 converge toward each other in an upward direction, although the present invention is not limited thereto. Also, main body portion 91 preferably inclines away from rear wall 78 in a downward direction, in a complementary manner to C-shaped guiding wall 62, and thereby decreases in size from a lower end to an upper end thereof. Tongue 90 is removably connectable within groove 60 and chamber 64 in order to removably connect lower step section 24 to the front of upper step section 22.

In order to assemble upper step section 22 and lower step section 24, lower step section 24 is positioned on the floor of the swimming pool. Then, upper step section 22 is positioned in the swimming pool, such that tongue 90 fits within groove 60 and chamber 64. Hand rails 54 can be inserted before or after positioning of upper step section 22 into the swimming pool. Thereafter, sealed bags of sand or other matter are inserted into chamber 42 in upper step section through large rectangular opening 48 in order to weigh down step assembly 20. Alternatively, the sealed bags can be placed in upper and lower step sections 22 and 24 just prior to insertion of the same into the swimming pool. Step assembly 20 can be moved a small amount into position such that rear wall 38 is against the side wall of the swimming pool. It will therefore be appreciated that set up of step assembly 20 is relatively easy.

Further, during storage and during shipping, lower step section 24 fits within upper step section 22, that is, through large rectangular opening 48 of rear wall 38. This is shown in FIG. 7. In order to do so, it is necessary to turn lower step section 24 by 90°, since lower step section 24 is of the same width as upper step section 22. Thus, step assembly 20, during storage and transport, occupies a much smaller space and can be shipped at a greatly reduced cost.

It will be appreciated that various modifications can be made to the invention within the scope of the claims. For example, the shape of step assembly 20 can be changed to a rounded or any other suitable shape. Further, although only two step sections 22 and 24 have been shown, the present invention is not limited thereto, and more than two sections can be provided which interfit within each other.

Further, while the present invention has been described in connection with a tongue and groove arrangement for detachably connecting upper step section 22 and lower step section 24 together, the present invention is not limited thereby. In such case, any other suitable arrangement can be provided, such as a clamp arrangement at the sides of sections 22 and 24, a strap arrangement, a bolt fastening arrangement, etc.

As another variant, tongue 90 can be formed on front wall 32 of upper step section 22, while groove 60 is formed in rear wall 78 of lower step section 24.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope or spirit of the invention as defined by the appended claims.

What is claimed is:

1. A step assembly for a swimming pool, comprising:

a unitary, one-piece, molded plastic, stand-alone upper step section including:

at least one upper step, each at least at a first height, a first supporting structure for supporting said at least one upper step on a ground surface as a stand-alone unit without any further supporting structure, said first supporting structure including a first front wall at a first front side, a first rear side, two first side walls at opposite sides extending between said first front side and said first rear side, at least a partial first bottom wall, and a first lower supporting wall in a common plane for supporting said first supporting structure on a flat surface and comprised of at least one of said first front wall, said first side walls and said at least partial first bottom wall, a hollow chamber defined between said first supporting structure and said at least one upper step, and an opening in a portion of said first supporting structure other than said front side for permitting access to said hollow chamber;

a unitary, one-piece, molded plastic, stand-alone lower step section including:

at least one lower step, each said lower step at a height lower than said first height, and a second supporting structure for supporting said at least one lower step as a stand-alone unit without any further supporting structure, said second supporting structure including a second front wall at a second front side, a second rear side, two second side walls at opposite sides extending between said second front side and said second rear side, at least a partial second bottom wall, and a second lower supporting wall in said common plane for supporting said second supporting structure on said flat surface and comprised of at least one of said second front wall, said second side walls and said at least partial second bottom wall;

a securing assembly for detachably securing said upper step section with said lower step section in a first assembled position such that said rear side of said second supporting structure of said lower step section is adjacent said front side of said first supporting structure of said upper step section and such that said steps of said lower and upper step sections form a sequential order of steps of different heights from a low height to a higher height; and said lower step section having dimensions less than said opening in said portion of said first supporting structure of said upper step section and inserted through said opening in said portion of said first supporting structure when disassembled from said upper step section so as to be entirely removably positioned in said hollow chamber in a second disassembled position.

2. A step assembly according to claim 1, wherein said at least one upper step includes two steps of different heights which are offset from each other in a horizontal direction and which are connected to each other by a riser.

3. A step assembly according to claim 2, further comprising at least one hand rail, and wherein said upper step section further includes hand rail holding sections for holding said at least one hand rail thereon.

4. A step assembly according to claim 3, wherein there are at least two hand rail holding sections, each including a cup-shaped wall for receiving an end of one said hand rail therein, at least one cup-shaped wall being associated with a first one of said steps of said upper step section and at least one cup-shaped wall being associated with a second one of said steps of said upper step section.

5. A step assembly according to claim 1, wherein said first front wall of said first supporting structure is connected with said at least one upper step, and said opposite first side walls are connected with said at least one upper step and with said first front wall.

6. A step assembly according to claim 5, wherein said first supporting structure further includes a rear wall at said rear side and connected with said at least one upper step and said first side walls, and said opening is formed in said rear wall.

7. A step assembly according to claim 6, wherein said at least partial first bottom wall includes a second opening therein to permit water to enter into said upper step section when said upper step section is positioned in a swimming pool.

8. A step assembly according to claim 5, wherein said front wall has a lower edge that extends substantially along an entire front edge of said upper step section, and each of said opposite side walls has a lower edge that extends substantially along an entire side of said upper step section, with all of said lower edges being coplanar.

9. A step assembly according to claim 1, wherein said securing assembly includes:

a first securing device connected with one of said first and second supporting structures, and a second securing device connected with the other of said first and second supporting structures for engaging with said first securing device to releasably secure said upper step section with said lower step section.

10. A step assembly according to claim 9, wherein said first securing device includes a female securing member and said second securing device includes a male securing member for releasably mating with said female securing member.

11. A step assembly according to claim 9, wherein said first securing device includes a groove and said second securing device includes a tongue which can removably fit within said groove.

12. A step assembly according to claim 11, wherein:

one of said groove and said tongue is formed in said front wall of said first supporting structure, and said second supporting structure includes a rear wall at said rear side and the other of said groove and said tongue is formed in said rear wall.

13. A step assembly according to claim 11, wherein:

said groove has a lower end which is open, and said tongue has similar dimensions and shape to said groove so as to removably fit within said groove.

14. A step assembly according to claim 13, wherein:

said groove has a substantially trapezoidal configuration such that side edges of said groove converge toward each other in an upward direction, and said tongue has a substantially trapezoidal configuration of similar dimensions and shape to said groove such that side edges of said tongue converge toward each other in the upward direction.

15. A step assembly according to claim 13, wherein:

said first securing device further includes a substantially C-shaped guiding wall formed with the respective one of said first and second supporting structures, said guiding wall extending substantially an entire height of said groove and defining a chamber therein which is in open communication with said groove, and said tongue includes a main body portion and a reduced neck portion by which said main body portion is connected with the respective one of said first and second supporting structures, said main body portion having a configuration and dimensions complementary to fit within the substantially C-shaped guiding wall and said reduced neck portion.

16. A step assembly according to claim 15, wherein:

said guiding wall inclines away from the respective one of said first and second supporting structures in a downward direction, and said main body portion inclines away from the respective one of said first and second supporting structures in a downward direction, in a complementary manner to said C-shaped guiding wall.

17. A step assembly according to claim 15, wherein:

said groove and said substantially C-shaped guiding wall each have a substantially trapezoidal configuration such that side edges of said groove converge toward each other in an upward direction and side edges of said guiding wall converge toward each other in the upward direction, and said main body portion and said reduced neck portion of said tongue each have a substantially trapezoidal configuration of similar dimensions and shape to said guiding wall and said groove, respectively, such that side edges of said main body portion converge toward each other in the upward direction and side edges of said reduced neck portion converge toward each other in the upward direction.

18. A step assembly according to claim 1, wherein said at least one lower step includes two steps of different heights which are offset from each other in a horizontal direction and which are connected to each other by a riser.

19. A step assembly according to claim 1, wherein said second front wall of said second supporting structure is connected with said at least one lower step, and said opposite second side walls are connected with said at least one lower step and with said second front wall.

20. A step assembly according to claim 19, wherein said second supporting structure includes a rear wall at said second rear side and connected with said at least one lower step and said second side walls.

21. A step assembly according to claim 20, wherein:

said at least partial second bottom wall includes a second opening therein to permit water to enter into said lower step section when said lower step section is positioned in a swimming pool, and at least one other wall of said second supporting structure includes a further opening for permitting egress of said water from within said second supporting structure.

* * * * *